US005848936A

United States Patent [19]

Morrison

[11] Patent Number: 5,848,936

[45] Date of Patent: Dec. 15, 1998

[54] CASINO APPARATUS AND METHOD OF PLAYING A GAME USING A SPINNING TOP

[76] Inventor: William C. Morrison, 4599 Carriage La., Las Vegas, Nev. 89119

[21] Appl. No.: 948,761

[22] Filed: Oct. 10, 1997

[51] Int. Cl.[6] ..... A63F 5/04

[52] U.S. Cl. ..... 463/17; 273/274; 273/147; 273/309; 463/25

[58] Field of Search ..... 273/147, 309, 273/274; 463/16, 17, 25

[56] References Cited

U.S. PATENT DOCUMENTS

| | | | |
|---|---|---|---|
| D. 21,753 | 8/1892 | Huntoon | 273/147 |
| D. 60,587 | 3/1922 | Striker | 273/147 |
| 76,572 | 4/1868 | Wight | 273/147 |
| D. 162,100 | 2/1951 | Wee | 273/147 |
| D. 196,801 | 11/1963 | Friedman | 273/147 |
| 459,832 | 9/1891 | Byram | 273/147 |
| 680,957 | 8/1901 | Backus | 273/147 |
| 897,137 | 8/1908 | Perkins | 273/147 |
| 1,321,589 | 11/1919 | Behringer | 273/147 |
| 1,452,618 | 7/1923 | Sayers | 273/147 |
| 1,469,151 | 9/1923 | Bartram | 273/147 |
| 1,522,189 | 1/1925 | Jacovatoes et al. | 273/142 R |
| 1,529,263 | 7/1925 | McGinnis | 273/147 |
| 1,546,451 | 12/1925 | Meyers | 273/147 |
| 1,565,669 | 12/1925 | O'Reilly | 273/147 |
| 2,023,297 | 12/1935 | Vandegrift | 273/147 |
| 2,311,453 | 2/1943 | McKeown | 273/147 |
| 2,583,805 | 1/1952 | Astle | 273/147 |
| 2,775,458 | 12/1956 | Raymond | 273/143 A |
| 2,794,644 | 6/1957 | Johnson | 273/147 |
| 2,976,045 | 2/1961 | Mason | 273/147 |
| 3,037,258 | 4/1962 | Anderson | 434/190 |
| 3,136,460 | 6/1964 | Ruderian | 273/147 |
| 3,693,977 | 9/1972 | De Keller | 273/274 |
| 4,299,392 | 11/1981 | Tammen | 273/274 |
| 4,834,372 | 5/1989 | Velazquez | 273/147 |
| 4,856,784 | 8/1989 | Magee | 273/147 |
| 5,570,885 | 11/1996 | Ornstein | 463/17 |

*Primary Examiner*—Benjamin H. Layno
*Attorney, Agent, or Firm*—Quirk & Tratos

[57] ABSTRACT

A method and device for playing a game are set forth which includes a spinning top to make random selections of outcomes. Players can wager on one or more color outcomes being generated by the top. When wagers have been made, a player spins the top which topples over to select an outcome. The dealer inputs the outcome to a processor which drives displays to display the outcome and input the current outcome on a display column showing the history of outcomes. Players are paid for winning wagers and are paid greater rewards for wagering on and obtaining consecutive same color outcomes.

18 Claims, 3 Drawing Sheets

CASINO APPARATUS AND METHOD OF PLAYING A GAME USING A SPINNING TOP

FIELD OF THE INVENTION

The present invention relates to games and more particularly wagering games using a spinning top to provide random outcomes.

BACKGROUND OF THE INVENTION

Wagering games are provided in casinos and the like for the enjoyment of their customers. These customers tend to gravitate to those games which offer fast action, visual stimulation and the opportunity to make large profits for relatively small wagers. Slot machines to some extent fill this need; however, slot machines lack an aspect of player control often desired by players. Furthermore, slot machines are played by one person and the outcomes obtained do not effect other players. Certain table games such as craps and Baccarat produce outcomes which can effect all or some of the players and therefore generate much excitement when all the players are winning. However, these table games, in particular craps, can be intimidating as to the different wagers that can be made. The often obtuse draw rules in Baccarat also intimidate and confuse players. Furthermore, in regards to baccarat, this game on the basic player/banker wager does not offer the opportunity to win more than even money. Furthermore, the players have no opportunity to participate in deriving the outcome which detracts from the personality of the game.

It has been known to provide a game wherein outcomes are derived by the spinning of a top. In Magee U.S. Pat. No. 4,856,784 issued Aug. 15, 1989, a spinning top is provided with eight sides denoted: take, put, and lose spin. A player spins the top which eventually topples over to show on the top one of the sides which, by the spinning of the top, has been randomly selected. If the top spin results in a take, the player spinning the top takes the pot. If the outcome is a put, the players ante into the pot and if the outcome is lose a spin, the top is passed to the next player.

The Magee game does not provide a simple game which is adaptable to being played in a casino since in Magee all players are "booking" the bets by making their "put" wagers. Further, Magee does not provide a means to visually highlight outcomes or provide a historical record of outcomes which would enhance the aspects of the game.

SUMMARY OF THE INVENTION

There is, therefore, set forth according to the present invention a casino game which incorporates a spinning top and which provides the opportunity to win payoffs several times a player's wager, which provides for visual stimulation before, during and after the play of the game and which overcomes the drawbacks heretofore encountered in the art.

Accordingly, a method is set forth wherein a player makes a wager on at least one of a plurality of outcomes. Preferably four different outcomes are provided and are indicated by the colors red, green, blue and yellow. A top is spun which includes side faces each identified as one of the outcomes, the toppling over of the top as it slows positioning one of the faces to randomly select the game outcome. The method further includes paying the player having wagered on the game outcome a first reward. If the player has made consecutive wagers on the same outcome of consecutive games and the wagered upon game outcomes occur consecutively, the method includes paying the player a second, greater reward.

The method also includes visually displaying the outcomes and displaying the historical record for a certain number of game outcomes.

Also provided is a game device which includes a playing surface defining at least one player wagering area by which the player may indicate a wager on at least one of a plurality of outcomes. Preferably each wagering area is defined by lit panels which display the color outcomes upon which the player may wager. A top is provided and is adapted to be spun on the playing surface. The top includes side faces each identified as one of the game outcomes. The top is adapted to spin and topple over to position one of the faces to define the game outcome. Means are provided to indicate the individual game outcome and consecutive games of the same outcome. Accordingly, if a player has wagered upon an outcome and that outcome occurs, the player is declared to have won the wager and is entitled to a first reward. If the player has wagered upon consecutive games of the same outcome and the same, consecutive outcomes occur, the player is entitled to a second, greater reward.

As can be appreciated, the method and game according to the present invention provides players with the opportunity to win amounts several times their wager, particularly when the player wagers upon consecutive outcomes and indeed consecutive, same outcomes occur. Furthermore, by providing the lit panels and other aspects of the present invention, visual stimulation is provided. The use of the top which is spun by the players and the visual stimulation provided by the game tends to promote excitement and a feeling of a team effort at the table which enhances the appeal of the game.

BRIEF DESCRIPTION OF THE DRAWINGS

These and other features of the present invention will become better appreciated with reference to the specification, claims and drawings wherein:

DESCRIPTION

Figure 1:
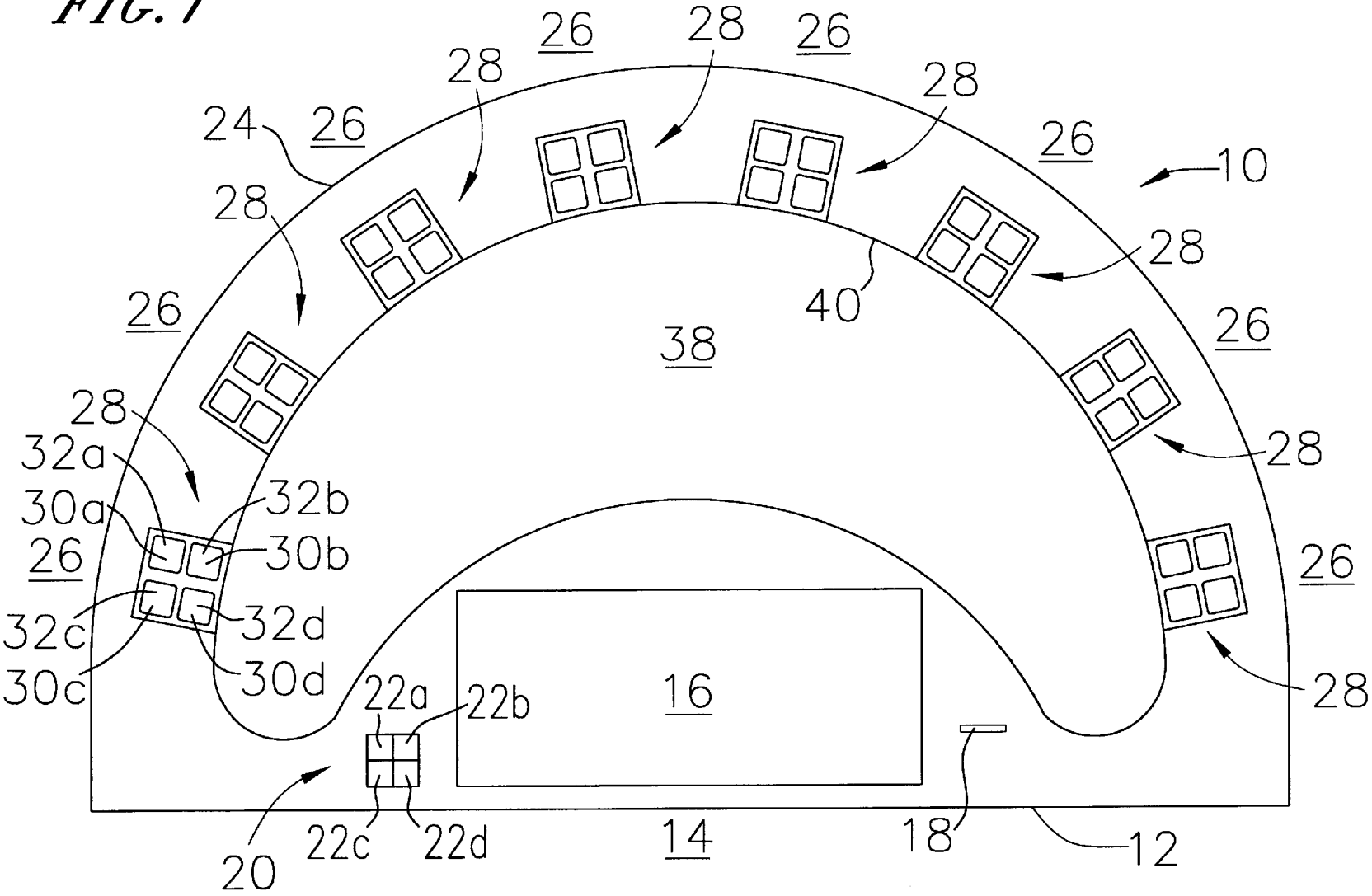
FIG. 1 is a plan view of a playing surface for the game.

Turning to the drawings, FIG. 1 shows a playing surface 10 preferably displayed on a table top of a size and shape similar to that currently used for blackjack tables. The playing surface 10 defines at a linear side 12 a dealer position 14 occupied by the dealer during the play of the game. Proximate the dealer position 14 is a chip rack 16 of known design adapted to hold the chips paid out and collected during the play of the game. To one side of the chip rack 16 is a cash drop slot 18 through which, also in a known manner, the dealer deposits cash used by the players to buy chips or tokens for the play of the game. Also to one side of the chip rack 16 is a dealer control panel 20 preferably divided into quadrants 22*a–b* the purpose of which will hereinafter become evident.

The playing surface 10 also has an arcuate side 24 around which are defined eight player positions 26 to be occupied by players during the play of the game. At each player position is a wagering location 28 at which each player indicates the outcome upon which they are placing a wager.

Preferably each location 28 is defined by a matrix of four squares each adapted to denote an outcome. While the outcome may be numbers or letters, preferably each of the squares 30*a–d* is of a different color, i.e. square 30*a* is yellow, square 30*b* is green, square 30*c* is blue and square 30*d* is red. It is to be understood that other color combinations may be used and that the colors of each square 30*a–d* need not be solid but may be highlighted with logos or other artistic embellishments.

Figure 5:
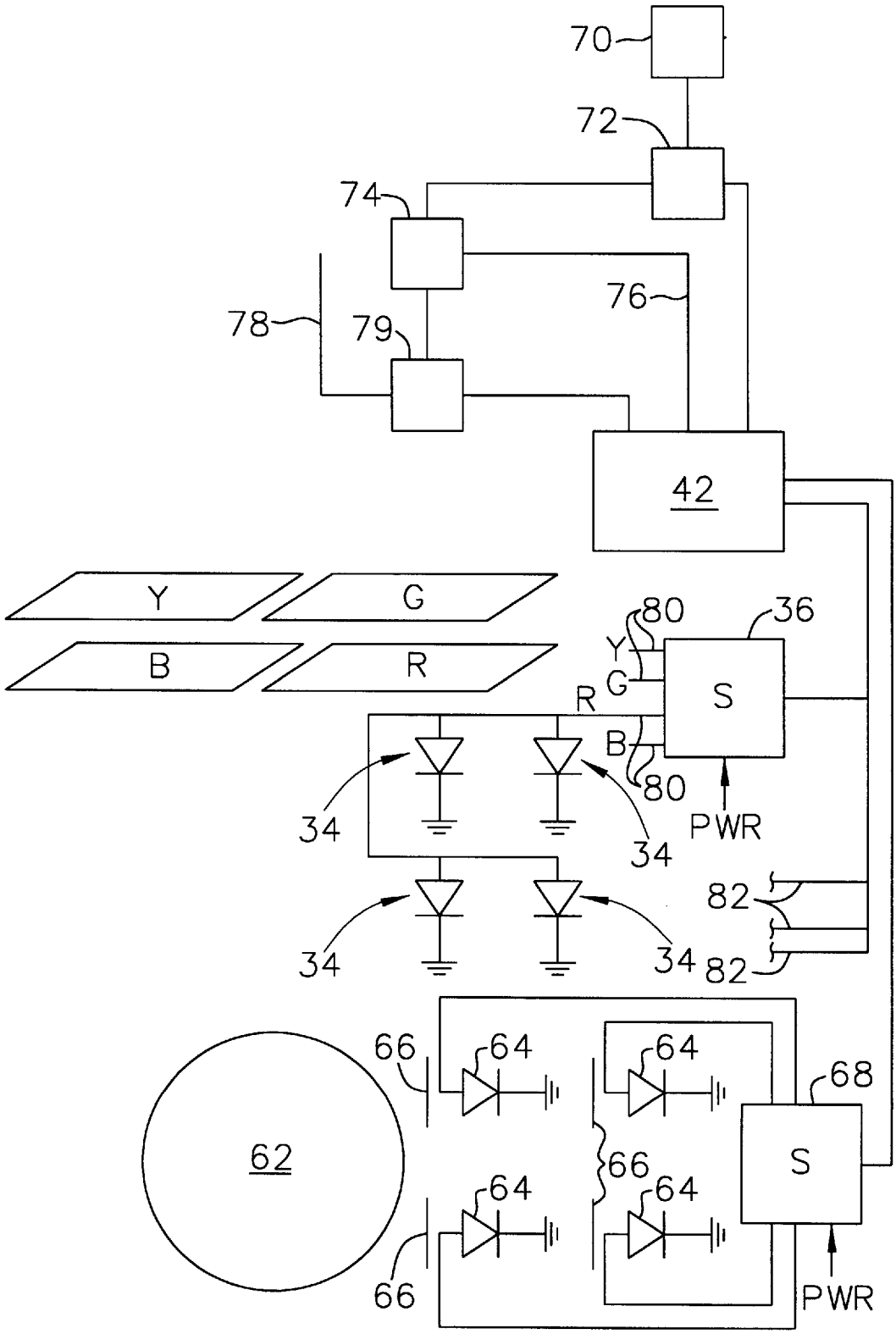
FIG. 5 is a logic diagram showing the various visual displays and controls for the game.

While each wagering location 28 may be imprinted on the table, preferably each of the squares 30*a–d* is defined by lit panel glasses 32*a–d* (FIG. 5) adapted to light in the aforementioned colors. While the glass 32*a–d* may be clear with the color defined by a colored light, preferably each glass 32*a–d* is tinted in the desired color and is backlit by light emitting diodes, LEDs 34 (FIG. 5). As shown in FIG. 5, each glass, shown as glass 32*d* in the color red, is backlit by four LEDs 34 connected in series to a select switch 36 the purpose of which will hereinafter become evident. In that all of the glasses 32*a–d* are backlit by four LEDs 34, only the arrangement for glass 32*d* is shown in detail in FIG. 5.

It is to be understood that while the preferred embodiment employs LEDs 34 to backlight the glasses 32*a–d*, it is to be understood that liquid crystal displays or the like could also be used.

Returning to FIG. 1, between the chip rack 16 and player wagering locations 28 is located a kidney shaped spin surface 38 which preferably is fabricated from a hard material and is depressed with respect to the surrounding portions of the playing surface 10. Preferably the perimeter 40 of the spin surface 38 is tapered as by a fillet or ramp configuration from the playing surface to the spin surface 38. Thus the fillet or ramping of the perimeter 40, as discussed below, is adapted to confine the spinning top hereinafter described to within the spin surface 38 during the play of the game.

Disposed at the underside of the playing surface 10 is a controlling processor 42 (FIG. 5) and related circuitry to control the visual displays during the play of the game as hereinafter described.

Figure 2:
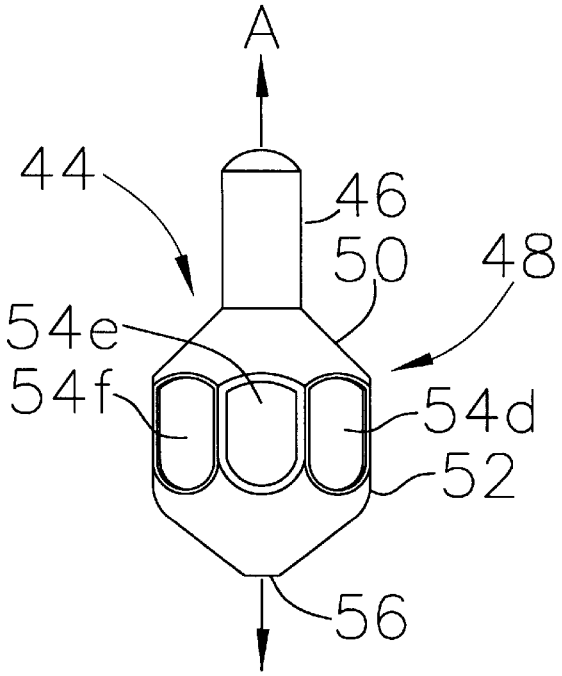
FIG. 2 is a side view of a top for the game adapted to produce random outcomes.
Figure 3:
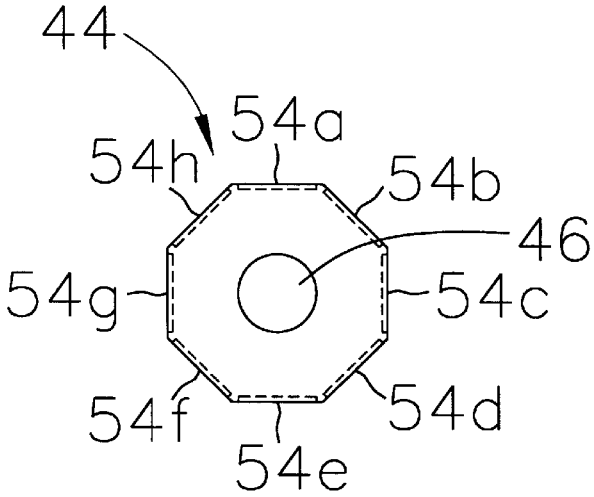
FIG. 3 is a top plan view of the top of FIG. 2.

To randomly select outcomes, the game includes a top 44 as shown in FIGS. 2 and 3. The top has a cylindrical handle 46 by which the player initiates spinning of the top 44 between the thumb and forefinger. The handle 46 terminates at an enlarged, body 48. The body 48 from the handle 46 enlarges by a conical section 50 to a cylindrical, outer surface 52 having defined thereon an octagonal pattern, eight flattened sides 54*a–h*. Each side is of the same size and configuration as the other to maintain the symmetry of the top about its spin axis A. From the outer surface 52 and its sides 54*a–h,* the body 48 conically tapers to a point 56 which is axially aligned along spin axis A for the top 44. Preferably the top 44 is balanced about spin axis A to assure the random selection of outcomes as hereinafter described.

Each of the sides 54*a–h* defines one of the outcomes for the game. In the preferred embodiment where the outcomes can be colors of red, green, yellow and blue, each of the sides 54*a–h* bears one of the aforesaid colors. Preferably, since there are eight sides 54*a–h* and four colors, the diametrically opposed sides are of the same color. Therefore sides 54*a,e* are red, sides 54*b,f* are green, sides 54*c,g* are yellow and sides 54*d,h* are blue. The coloring of the sides 54*a–h* may be as by adhering color decals to the sides or by exterior paint. Preferably the top is fashioned from an acrylic or other high density material and the colors of the sides 54*a–h* are incorporated therein. Also preferably, the top is approximately 2.712 inches tall and 1.52 inches in diameter at the outside surface 52. Also preferably, the handle 46 is approximately 1 inch long.

To randomly select an outcome for the game, a selected player grasps the top 44 by the handle 46 and spins the top 44 on the spin surface 38. The perimeter 40 of the spin surface 36 confine the spinning top 44 to the spin surface 38. The spinning top 44 eventually slows and topples over falling on one of its sides 54*a–h*. In that the sides 54*a–h* are flat, as best shown in FIG. 3, the top 44 eventually comes to rest squarely on one of the sides 54*a–h*. In this position, the diametrically opposed side 54*a–h* is facing upwardly and defines the outcome of the spin and the game. Again, this outcome may be one of the colors, red, green, yellow and blue according to the preferred embodiment of the present invention.

To record the outcome of the spin of the top, the dealer uses the panel 20 (FIG. 1) by depressing the correspondingly colored quadrant 22*a–d* thereof. Switch means within the panel 20 issues outcome signals 58 to the processor 42. With this data, the processor 42 can generate the displays as hereinafter set forth.

Figure 4:
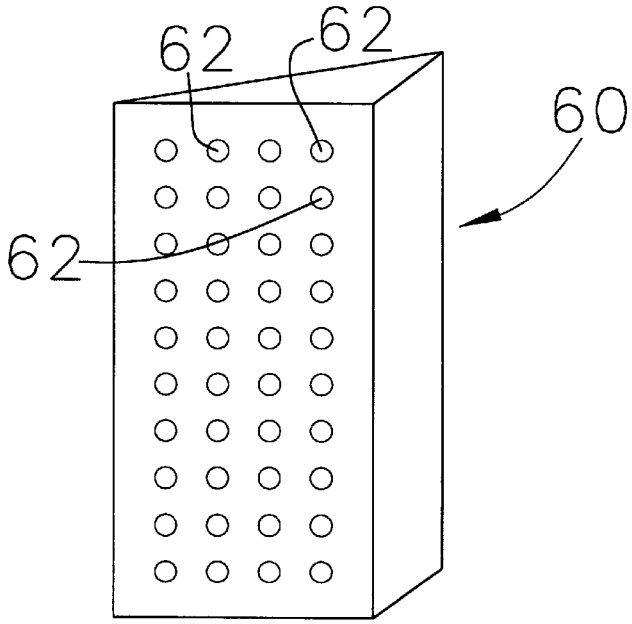
FIG. 4 is a front perspective view of a history board adapted to provide historical record of outcomes.

With reference to FIG. 4, the game may also include means to record on a historical basis game outcomes. This historical record is preferably embodied by a display column 60 including a plurality of lenses 62 arranged in sequential columns. Behind each of the lenses 62, as illustrated in FIG. 5, are four LEDs 64 having disposed between them and the lens 62 tinted transparencies 66 each colored in one of the outcome colors for the game. Thus transparencies 66*a–d* are tinted in the colors of red, green, yellow and blue, respectively. The LEDs 64 are controlled by an externally powered selector switch 68 which controls the powering of each of the LEDs 64 to project the corresponding color of the outcome through the lens 62. By lighting the lenses 62 of the column display 60 in a right to left, top to bottom fashion, the players will view the historical record of outcomes by looking at the colors projected by the lenses 62. It is to be understood that the column display can have any suitable format or presentation. Furthermore, the column display 60 could be replaced with a monitor providing visual displays of the historical outcomes in various formats such as frequency and the like.

With the components of the game described above, the play of the game will now be set forth.

With reference to FIG. 5, the game starts with the dealer initiating the controller 42 at a start 70. Start may be initiated by the dealer touching any one of the quadrants 22*a–d* of the panel 20. At 72 the processor prompts as to whether or not the game is in an idle or in a play state. At idle, when there are no players but the game is available for play, the processor 42 is controlled to operate in an idle mode. In this mode, the processor may be programmed to light the glasses 32*a–d* of the wagering locations 28 in an appealing fashion such as by flashing colors and in sequence around the table at the wagering locations 28 to attract players to play the game. Furthermore, the processor 42 may control the display column 60 to also light in an appealing fashion.

When players approach the table, the dealer initiates play as by touching one or a selected one of the quadrants 22*a–d* as shown at 74 which issues a signal 76 to the processor to switch it from the idle mode to a play mode. In this mode, the processor 42 controls the LEDs 34 to light all of the glasses 32*a–d* at all the wagering locations 28 so that the players may identify which color they wish to wager upon. Furthermore, the processor 42 either recalls the history of outcomes and appropriately lights the lenses 62 of the display column 60 to reflect that historical record or, in the alternative, erases from memory the history of outcomes to start anew the historical recording of outcomes for this group of players. After the players have made their wagers, a selected player is designated to spin the top 44. The selected player grasps the top 44 and spins it in the spin surface 38. The top, as describved above, gradually slows and topples over unto one of its sides 54*a–h* to display a color outcome. The dealer viewing the color outcome, depresses the corresponding colored quadrant 22*a–d* issuing a signal at 78 to a switch 79 which issues an outcome signal to the processor 42. The processor 42 recognizes the outcome signal and in response thereto sends controlling signals to selector switch 36 to de-energize the LEDs 64 beneath the glasses 32*a–d* which do not correspond to the color of the outcome. Furthermore, the processor 42 issues a signal to selector switch 68 which energizes the LED 64 corresponding to the color of the outcome for the lens 62 at the next sequential location of a historical record displayed at the display column 60. The outcome is also stored in a data structure for maintaining the historical record of outcomes. Lines 80 from selector switch 36 illustrate the power lines to power the LEDs behind each of the colored glasses. Similarly lines 82 illustrate signals from the processor 42 being issued to the other player location controlling selectors.

If a player has correctly wagered upon the outcome color, they are paid in an amount greater than even money. Preferably this amount is, according to the method of the present invention, 2 to 1. Furthermore, if the player who spun the top has made a winning wager, that player has the opportunity to spin again.

Also, for players having made winning wagers, the dealer may place a token or marker next to the winning players color wager for the purposes of determining consecutive, same color winning outcomes. According to the method of the present invention, if the player has made a correct wager by wagering on, for example, a red outcome and the top indeed produced a red outcome, the player can opt to attempt to repeat the outcome to achieve even greater rewards. For example, if the player wagers upon and obtains two consecutive, same color, outcomes, that player's wager is paid at even greater odds but preferably 6 to 1. If the player wagers upon and obtains a third, consecutive, same outcome, that player's wager is paid at even greater odds but preferably 12 to 1.

Players wagering on colors which do not match the outcome have their wagers collected by the dealer.

The following examples illustrate the play of the game.

Player 1 wagers 5 tokens on the color red and player 2 wagers 5 tokens on the color yellow. Player 1 spins a red outcome. The dealer, in a manner described above, illuminates the red glasses 32*a* and the column display 60 indicates a red outcome. Player 1 is paid 10 tokens and player 2's tokens are collected.

Player 1 parlays his wager on red, now wagering 15 tokens (the original 5 token wager plus the winnings of 10 tokens). The dealer places a marker next to player 1's red color wager. Player 2 wagers 5 tokens on red. Player 1 spins a consecutive, red outcome. The dealer again initiates the controller 42 to light the red glasses at the wagering locations 28 and at display column 60. Player 1 is paid 6 to 1 or 90 tokens for spinning a consecutive, red outcome. Player 2 is paid 10 tokens (2 to 1). The dealer uses a marker to indicate that player 1 has wagered upon and obtained back to back red outcomes.

Player 1 wagers 20 tokens on red and player 2 wagers 10 tokens on green. Player 1 spins a blue outcome. Both players lose their wagers. Had player 1 spun a third, consecutive red outcome, player 1 would have been paid 12 to 1 for his wager.

After the bets are paid or collected and consecutive wagers are indicated by the dealer placing a marker, play continues in the manner described above.

While I have shown and described certain embodiments of the present invention, it is to be understood that it is subject to many modifications and changes without departing from the spirit and scope of the appended claims.

I claim:

1. A method for playing a game comprising:

the player making a wager on at least one of a plurality of outcomes;

spinning a top including a plurality of side faces each identified as one of said outcomes, said top toppling over to position one of the faces to define a resulting game outcome; and paying the player having wagered on a game outcome corresponding to the resulting game outcome, a first reward and if the player has made consecutive wagers on the same outcome of consecutive games and the wagered upon game outcomes occur from results of consecutive spins of the top, paying the player a second reward.

2. The method of claim 1 including spinning a top having sides identified by colors, said top toppling over to position a face to define a color as a game outcome.

3. The method of claim 2 including spinning a top having eight sides, two of which each bear a color of red, green, blue and yellow.

4. The method of claim 3 including paying the player if the player makes the corresponding wager(s) according to the following Table 1

TABLE 1

| | |
|---|---|
| Single Outcome | 2 to 1 |
| Two Consecutive Same Outcomes | 6 to 1 |
| Three Consecutive Same Outcomes | 12 to 1 |

5. A method for playing a game comprising:

providing a playing surface having identified thereon locations for a player to make a wager on a game outcome;

the player making at least one wager on at least one of a plurality of outcomes;

spinning a top on the playing surface, the top having a plurality of sides each identifying an outcome for the game, the top toppling over to position one of its sides to define a resulting game outcome;

paying the player having wagered on a game outcome corresponding to the resulting game outcome a first reward and if the player has made consecutive wagers on the same outcome of consecutive games and the wagered upon game outcomes occur from results of consecutive spins of the top, paying the player a second reward.

6. The method of claim 5 including providing a playing surface having a dished portion adapted to confine the spinning top.

7. The method of claim 5 including spinning a top having sides identified by colors, said top toppling over to position a face to define a color as a game outcome.

8. The method of claim 7 including spinning a top having eight sides, two of which each bear a color of red, green, blue and yellow.

9. The method of claim 8 including providing a playing surface having for the player four color wagering zones for the player to wager upon the anticipated game outcome.

10. The method of claim 7 including paying the player if the player makes the corresponding wager(s) according to the following Table 1

TABLE 1

| | |
|---|---|
| Single Outcome | 2 to 1 |
| Two Consecutive Same Outcomes | 6 to 1 |
| Three Consecutive Same Outcomes | 12 to 1 |

11. A casino game comprising:

a playing surface defining at least one player wagering area by which the player may indicate a wager on at least one of a plurality of outcomes;

a top adapted to be spun on the playing surface, the top including a plurality of side faces each side face identified as one of said game outcomes, the top adapted to spin and topple over to position one of the faces to define a resulting game outcome;

means to indicate individual game outcomes and consecutive games of the same outcome;

whereby if the player has wagered upon an outcome and that outcome occurs from the result of the spinning of the top, the player is declared to have won the wager and is entitled to a first reward and if the player has wagered upon consecutive games of the same outcome and same, consecutive outcomes occur from results of consecutive spins of the top, the player is entitled to a second, greater reward.

12. The game of claim 11 wherein said playing surface includes a dished portion.

13. The game of claim 11 including an electronically generated display to define the wagering areas for the players.

14. The game of claim 13 including means to generate at the display game outcomes and consecutive game outcomes and means to enter the game outcomes.

15. The game of claim 11 wherein said top has eight sides, four pairs of sides each denoted by a distinguishing color, said sides defining four possible color outcomes.

16. The game of claim 15 including an electronically generated display showing at each wagering area the possible color outcomes.

17. The game of claim 16 further including indicators at the display adapted to electronically indicate game and consecutive game outcomes.

18. A casino game comprising:

a playing surface having a dished portion and a four color display, each color defining a player wagering area by which the player may indicate a wager on at least one of a plurality of color outcomes;

a top adapted to be spun on the playing surface, the top including eight side faces four pairs of which are each denoted by a distinguishing color corresponding to the plurality of color outcomes, the top adapted to spin in the dished portion and topple over to position one of the faces to define a resulting game color outcome;

means to indicate at the display individual game outcomes and consecutive games of the same outcome;

whereby if the player has wagered upon an outcome and that outcome occurs from the result of the spinning of the top, the player is declared to have won the wager and is entitled to a first reward and if the player has wagered upon consecutive games of the same outcome and same, consecutive outcomes occur from results of consecutive spins of the top, the player is entitled to a second, greater reward.

* * * * *